US007665520B2

(12) United States Patent
Szarka et al.

(10) Patent No.: US 7,665,520 B2
(45) Date of Patent: Feb. 23, 2010

(54) MULTIPLE BOTTOM PLUGS FOR CEMENTING OPERATIONS

(75) Inventors: David D. Szarka, Duncan, OK (US); Henry E. Rogers, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 124 days.

(21) Appl. No.: 11/615,180

(22) Filed: Dec. 22, 2006

(65) Prior Publication Data

US 2008/0149336 A1 Jun. 26, 2008

(51) Int. Cl.
*E21B 33/16* (2006.01)

(52) U.S. Cl. ..... 166/291; 166/153; 166/156

(58) Field of Classification Search ..... 166/153, 166/156, 291
See application file for complete search history.

(56) References Cited

U.S. PATENT DOCUMENTS

| | | | | |
|---|---|---|---|---|
| 2,164,195 A | | 6/1939 | Waltermire | 137/77 |
| 2,627,314 A | | 2/1953 | Baker et al. | 166/1 |
| 2,856,002 A | | 10/1958 | True et al. | 166/114 |
| 2,913,054 A | | 11/1959 | Falk | 166/224 |
| 3,050,121 A | | 8/1962 | Garrett et al. | 166/46 |
| 3,065,794 A | | 11/1962 | Page | 166/125 |
| 3,091,294 A | | 5/1963 | Evans et al. | 166/193 |
| 3,111,988 A | | 11/1963 | Davis et al. | 166/42 |
| 3,289,762 A | | 12/1966 | Schell et al. | 166/35 |
| 3,314,479 A | | 4/1967 | McCullough et al. | 166/63 |
| 3,653,435 A | | 4/1972 | Reistle et al. | 166/366 |
| 3,796,260 A | * | 3/1974 | Bradley | 166/153 |
| 4,044,827 A | | 8/1977 | Kerzee et al. | 166/133 |
| 4,069,535 A | | 1/1978 | Cato | 15/104.061 |
| 4,083,076 A | | 4/1978 | Girard | 15/140.061 |
| 4,083,406 A | | 4/1978 | Metz | 166/286 |
| 4,345,402 A | | 8/1982 | Hanson et al. | 446/430 |
| 4,378,838 A | | 4/1983 | Ogden et al. | 166/153 |
| 4,499,951 A | | 2/1985 | Vann | 166/297 |
| 4,509,222 A | | 4/1985 | Knapp | 15/104.061 |
| 4,512,398 A | | 4/1985 | Hazel | 166/70 |
| 4,531,583 A | | 7/1985 | Revett | 166/277 |

(Continued)

FOREIGN PATENT DOCUMENTS

| | | |
|---|---|---|
| EP | 0697496 | 2/1996 |

(Continued)

OTHER PUBLICATIONS

Foreign communication, May 2, 2007.

(Continued)

*Primary Examiner*—Shane Bomar
(74) *Attorney, Agent, or Firm*—John W. Wustenberg; Baker Botts, LLP

(57) ABSTRACT

Methods and devices useful in stage cementing operations are provided. One example of an apparatus may comprise a catcher tube assembly and a deformable device. One example of a method is a method of stage cementing a casing string comprising: positioning a catcher tube on top of a float collar; pumping a first fluid through the casing string; placing a first deformable device in the casing string; and pumping a second fluid through the casing string, thereby causing the first deformable device to translate downward in the casing string and into the catcher tube.

7 Claims, 3 Drawing Sheets

U.S. PATENT DOCUMENTS

| | | | | |
|---|---|---|---|---|
| 4,545,434 | A | 10/1985 | Higgins | 166/217 |
| 4,633,946 | A | 1/1987 | Jackson | 166/187 |
| 4,671,358 | A | 6/1987 | Lindsey et al. | |
| 4,674,573 | A | 6/1987 | Bode | 166/291 |
| 4,718,495 | A | 1/1988 | Lubitz et al. | |
| 4,797,239 | A | 1/1989 | Cho | 264/45.5 |
| 4,836,279 | A | 6/1989 | Freeman | 166/153 |
| 4,862,966 | A | 9/1989 | Lindsey et al. | 166/382 |
| 4,880,058 | A | 11/1989 | Lindsey et al. | |
| 4,907,649 | A | 3/1990 | Bode | 166/70 |
| 5,020,597 | A | 6/1991 | Braddick et al. | |
| 5,036,922 | A | 8/1991 | Braddick | 166/383 |
| 5,103,492 | A | 4/1992 | Ticknor | |
| 5,234,052 | A | 8/1993 | Coone et al. | 166/155 |
| 5,311,940 | A | 5/1994 | LaFleur | 166/152 |
| 5,325,917 | A | 7/1994 | Szarka | |
| 5,381,862 | A | 1/1995 | Szarka et al. | |
| 5,394,941 | A | 3/1995 | Venditto et al. | |
| 5,398,763 | A | 3/1995 | Watson et al. | 166/382 |
| 5,432,270 | A | 7/1995 | Zasloff et al. | 536/23.5 |
| 5,433,270 | A | 7/1995 | LaFleur | 166/152 |
| 5,435,386 | A | 7/1995 | LaFleur | 166/156 |
| 5,443,124 | A | 8/1995 | Wood et al. | 166/374 |
| 5,497,829 | A | 3/1996 | Rajkovich | 166/285 |
| 5,722,491 | A | 3/1998 | Sullaway et al. | |
| 5,738,171 | A | 4/1998 | Szarka | |
| 5,762,139 | A | 6/1998 | Sullaway et al. | |
| 5,829,523 | A | 11/1998 | North | 166/250.14 |
| 5,909,771 | A * | 6/1999 | Giroux et al. | 166/120 |
| 5,928,049 | A | 7/1999 | Hudson | 446/4 |
| 5,960,881 | A * | 10/1999 | Allamon et al. | 166/291 |
| 5,979,557 | A | 11/1999 | Card et al. | 166/300 |
| 6,082,451 | A | 7/2000 | Giroux et al. | |
| 6,196,311 | B1 | 3/2001 | Treece | 166/192 |
| 6,318,472 | B1 | 11/2001 | Rogers et al. | |
| 6,547,007 | B2 | 4/2003 | Szarka et al. | |
| 6,725,917 | B2 | 4/2004 | Metcalfe | 166/153 |
| 6,725,935 | B2 | 4/2004 | Szarka et al. | |
| 6,772,835 | B2 | 8/2004 | Rogers et al. | |
| 6,796,377 | B2 | 9/2004 | Butterfield, Jr. et al. | |
| 6,880,636 | B2 | 4/2005 | Rogers et al. | 166/290 |
| 6,951,246 | B2 | 10/2005 | Tessier et al. | 166/153 |
| 6,973,966 | B2 | 12/2005 | Szarka | |
| 7,080,687 | B2 | 7/2006 | Butterfield, Jr. et al. | |
| 7,182,135 | B2 | 2/2007 | Szarka | |
| 7,255,162 | B2 | 8/2007 | Stevens et al. | |
| 7,322,413 | B2 | 1/2008 | Rogers et al. | |
| 7,322,432 | B2 | 1/2008 | Rogers et al. | |
| 7,357,181 | B2 | 4/2008 | Webb et al. | |
| 2002/0100590 | A1 | 8/2002 | De Almeida | 166/339 |
| 2005/0103493 | A1 | 5/2005 | Stevens et al. | 166/265 |
| 2006/0243455 | A1 * | 11/2006 | Telfer et al. | 166/386 |
| 2007/0012448 | A1 | 1/2007 | Rogers et al. | |
| 2007/0062700 | A1 | 3/2007 | Webb et al. | |
| 2007/0095527 | A1 | 5/2007 | Szarka | 166/156 |
| 2007/0095538 | A1 | 5/2007 | Szarka et al. | 166/308.1 |
| 2007/0102158 | A1 | 5/2007 | Szarka | |
| 2007/0102159 | A1 | 5/2007 | Szarka | |
| 2008/0087430 | A1 * | 4/2008 | Robichaux et al. | 166/285 |
| 2008/0135248 | A1 * | 6/2008 | Talley et al. | 166/285 |
| 2008/0149336 | A1 | 6/2008 | Szarka et al. | |
| 2008/0164029 | A1 | 7/2008 | Rogers et al. | |
| 2008/0190611 | A1 | 8/2008 | Tjorswaag et al. | |
| 2008/0190613 | A1 | 8/2008 | Tjorswaag et al. | |

FOREIGN PATENT DOCUMENTS

| | | |
|---|---|---|
| EP | 1126131 A1 | 8/2001 |
| SU | 1439264 | 11/1988 |
| SU | 1548469 | 3/1990 |
| WO | WO 02/25056 | 3/2002 |
| WO | WO2005052312 | 6/2005 |
| WO | WO2005052316 | 6/2005 |
| WO | WO2007051969 | 5/2007 |
| WO | WO2007051970 | 5/2007 |

OTHER PUBLICATIONS

Foreign communication, Feb. 12, 2007.
Foreign communication related to a counterpart application dated Apr. 9, 2008.
Brochure Entitled "Landing Nipples and Lock Mandrels," from Otis Engineering Corp., General Sales Catalog.
Halliburton Casing Sales manual, Section 4.14, "SSR Plug Releasing Darts."
Foreign Communication from a Related Counterpart Application, Feb. 2, 2005.
Foreign Communication from a Related Counterpart Application, Apr. 13, 2006.
Foreign Communication from a Related Counterpart Application, Feb. 14, 2007.
Office Action from U.S. Appl. No. 11/263,729, Oct. 24, 2007.
Office Action from U.S. Appl. No. 11/263,729, May 18, 2007.
Office Action from U.S. Appl. No. 10/714,832—Notice of Allowance, Oct. 12, 2005.
Office Action from U.S. Appl. No. 10/714,832, May 19, 2005.
Final Office Action from U.S. Appl. No. 10/714,831, Jun. 5, 2006.
Office Action from U.S. Appl. No. 10/714,831, Dec. 30, 2005.
Final Office Action from U.S. Appl. No. 11/263,730, Oct. 22, 2007.
Office Action from U.S. Appl. No. 11/263,730, May 18, 2007.
U.S. Appl. No. 11/620,455, Jan. 6, 2007.
Halliburton Casing Sales Manual, Section 4, Cementing Plugs, p. 4.9-3 and 4.9-5, Apr. 2005.
Halliburton Casing Sales Manual, Sections, Multiple Stage Cementing Equipment, p. 5.5-7, May 2004.

* cited by examiner

MULTIPLE BOTTOM PLUGS FOR CEMENTING OPERATIONS

BACKGROUND

The present disclosure generally relates to subterranean cementing operations. More particularly, the present disclosure relates to cementing plugs in stage cementing operations and associated methods of use.

During the drilling and construction of subterranean wells, casing strings are generally introduced into the well bore. To stabilize the casing, a cement slurry is often pumped downwardly through the casing, and then upwardly into the annulus between the casing and the walls of the well bore. One concern in this process is that, prior to the introduction of the cement slurry into the casing, the casing generally contains a drilling or some other servicing fluid that may contaminate the cement slurry. To prevent this contamination, a subterranean plug, often referred to as a cementing plug or a "bottom" plug, may be placed into the casing ahead of the cement slurry as a boundary between the two. The plug may perform other functions as well, such as wiping fluid from the inner surface of the casing as it travels through the casing, which may further reduce the risk of contamination.

Similarly, after the desired quantity of cement slurry is placed into the casing, a displacement fluid is commonly used to force the cement into the desired location. To prevent contamination of the cement slurry by the displacement fluid, a "top" cementing plug may be introduced at the interface between the cement slurry and the displacement fluid. This top plug also wipes cement slurry from the inner surfaces of the casing as the displacement fluid is pumped downwardly into the casing. Sometimes a third subterranean plug may be used, to perform functions such as preliminarily calibrating the internal volume of the casing to determine the amount of displacement fluid required, for example, or to separate a second fluid ahead of the cement slurry (e.g., where a preceding plug may separate a drilling mud from a cement spacer fluid, the third plug may be used to separate the cement spacer fluid from the cement slurry), for instance.

In some circumstances, a pipe string will be placed within the well bore by a process comprising the attachment of the pipe string to a tool (often referred to as a "casing hanger and run-in tool" or a "work string") which may be manipulated within the well bore to suspend the pipe string in a desired sub surface location. In addition to the pipe string, a sub-surface release cementing plug system comprising a plurality of cementing plugs may also be attached to the casing hanger and run-in tool. Such cementing plugs may be selectively released from the run-in tool at desired times during the cementing process. Additionally, a check valve, typically called a float valve, will be installed near the bottom of the pipe string. The float valve may permit the flow of fluids through the bottom of the pipe string into the annulus, but not the reverse. A cementing plug will not pass through the float valve.

When a first cementing plug (often called a "bottom plug") is deployed from a sub-surface release cementing plug system and arrives at the float valve, fluid flow through the float valve is stopped. Continued pumping results in a pressure increase in the fluids in the pipe string, which indicates that the leading edge of the cement composition has reached the float valve. Operations personnel then increase the pump pressure to rupture a frangible device, within the bottom plug. Said frangible device may be in the form of a pressure sensitive disc, rupturable elastomeric diaphragm, or detachable plug (stopper) portion which may or may not remain contained within the bottom plug. After the frangible device has ruptured, the cement composition flows through the bottom plug, float valve and into the annulus. When the top plug contacts the bottom plug which had previously contacted the float valve, fluid flow is again interrupted, and the resulting pressure increase indicates that all of the cement composition has passed through the float valve.

Conventional cementing plugs are formed with wiper fins on their exterior surface, which function to wipe the pipe string as they travel downhole. Conventional cementing plugs used to wipe large diameter casing strings (18⅝ and larger) are by their very nature expensive to make, both heavy and bulky to handle, and require additional time to drill out due to the sheer volume of drillable materials to be removed. Under some conditions it may be advantageous to the well operator to run casing strings consisting of two or more pipe sizes, with the larger pipe size being at the shallowest depth and progressively tapering to the minimum pipe size. These casing configurations are typically known as "tapered strings" and require specially designed cementing plugs to wipe the different pipe diameters involved. Conventional cementing plugs are thus, fairly complex devices that are relatively time-consuming and as a result, expensive to manufacture, difficult to use, and are more costly to drill out due to the increased plug length and/or material content.

In addition, cementing plugs may be required to pass through internal restrictions designed into special tools which may be incorporated into the pipe string, such as the seats in a plug operated multiple stage cementing device. The specially designed cementing plugs required to pass through these types of internal restrictions must both effectively wipe the casing internal diameter and pass through the internal restrictions with minimal pressure increase to avoid prematurely activating the tool. In these instances, it is generally impossible to place the special devices in tapered strings unless the device is located in the largest pipe size due to the increased pressure that would otherwise be required to force the mass of the larger wiper segments through the restrictions.

With the increased sophistication of cementing operations, different types of fluids may need to be displaced through the casing. To prevent contamination and or intermixing of the fluids, multiple cementing plugs or bottom plugs may be advantageous. In these operations, plugs, particularly floppy wiper plugs or darts may be used. As such, there is an increased risk of plugs wedging beside each other, which may increase circulation pressures significantly or could potentially bridge the casing against further fluid displacement.

SUMMARY

The present disclosure generally relates to subterranean cementing operations. More particularly, the present disclosure relates to cementing plugs in stage cementing operations and associated methods of use In one embodiment, the present disclosure provides an apparatus for cementing a casing string comprising a catcher tube assembly and a deformable device.

In another embodiment, the present disclosure provides a method of stage cementing a casing string comprising: positioning a catcher tube on top of a float collar; pumping a first fluid through the casing string; placing a first deformable device in the casing string; and pumping a second fluid through the casing string, thereby causing the first deformable device to translate downward in the casing string and into the catcher tube.

In another embodiment, the present disclosure provides a method of cementing a tapered string comprising: positioning a catcher tube on top of a float collar; pumping a first fluid through the tapered casing string; placing a first deformable device in the tapered casing string; and pumping a second fluid through the tapered casing string, thereby causing the first deformable device to translate downward in the tapered casing string and into the catcher tube.

The features and advantages of the present disclosure will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DESCRIPTION OF PREFERRED EMBODIMENTS

The present disclosure generally relates to subterranean cementing operations. More particularly, the present disclosure relates to cementing plugs in stage cementing operations and associated methods of use.

The methods and devices of the present disclosure may allow for multiple first stage fluid separations that would only be limited by the length of the catcher tube. The devices of the present disclosure may be used in at least two and three stage cement jobs both in conventional and tapered casing strings. Furthermore, the deformable devices of the present disclosure may have the ability to wipe the largest diameter of a tapered casing string as well as the smaller diameters, thereby eliminating the need for a special fabricated bottom plug in tapered casing strings. The devices of the present disclosure would be less expensive and more user friendly than by-pass plugs and combination plugs currently of use in the art. In addition, with the devices and methods of the present disclosure, the risk of premature stage tool opening as a result of passing multiple wiper plugs through the tool is reduced.

To facilitate a better understanding of the present invention, the following examples of certain embodiments are given. In no way should the following examples be read to limit, or define, the scope of the invention.

Figure 1:
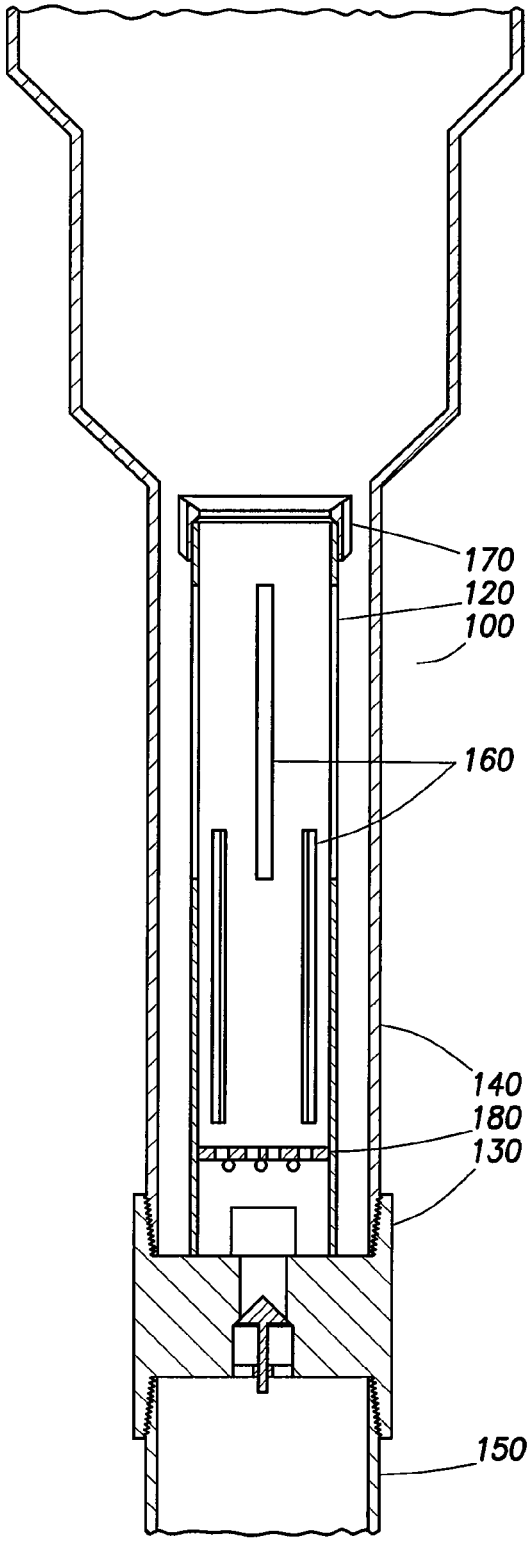
FIG. 1 illustrates a cross-sectional view of a catcher tube assembly in accordance with one embodiment of the present invention.

FIG. 1 illustrates a cross-sectional view of a catcher tube assembly 100 within casing string 140 in accordance with one embodiment of the present invention. Catcher tube 120 is seated upon float collar 130, which connects casing strings 140 and 150. The casing string may be, in certain embodiments, a tapered casing string, as illustrated in FIG. 1. The casing string may be, in other embodiments, a non-tapered casing string, as illustrated in FIGS. 2-6. Catcher tube 120 may be comprised of any suitable drillable material, including but not limited to, fiberglass, aluminum, and plexiglass. Catcher tube 120 may comprise slots 160 to enable a fluid pumped through casing string 140 to flow through catcher tube 120. The fluid may also flow around the outside diameter of the catcher tube 120. While catcher tube 120 is shown comprising slots 160 in this embodiment, the slots could be replaced by any kind of opening in the catcher tube which would allow for fluid flow therethrough while retaining deformable devices trapped within the catcher tube. Catcher tube assembly 100 may further comprise a centralizer 170 to maintain catcher tube 120 centrally positioned within casing string 140. In certain other embodiments, when a float collar is installed on a rig floor, a lower centralizer or elastomeric device may be used to maintain the catcher assembly suspended in the casing string. Catcher tube 120 further comprises a deformable device seat 180 positioned at the lower portion of catcher tube 120. Deformable device seat 180 may prevent passage of a deformable device through the catcher tube and into float collar 130. It may comprise openings to allow passage of fluid therethrough. A deformable device seat that may be used in conjunction with the apparatus of the present disclosure, may include, but is not limited to, a perforated plate. Although deformable device seat 180 is depicted as a separate piece from catcher tube 120, deformable device seat 180 may be integral to catcher tube 120. Deformable device seat 180 could be replaced by any device for allowing passage of fluid, while preventing the passage of deformable device 205.

Figure 2:
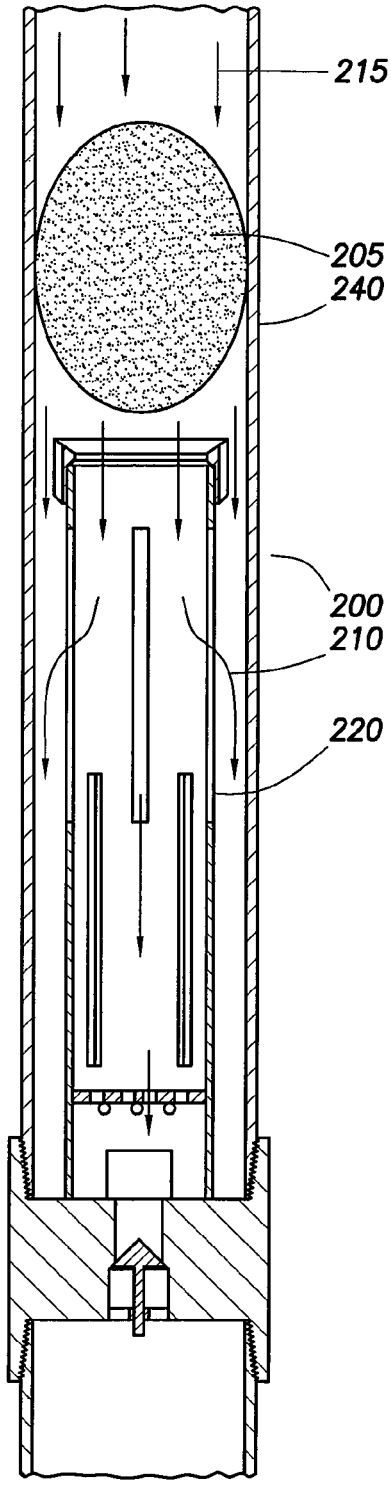
FIG. 2 illustrates a cross-sectional view of a catcher tube assembly with a deformable device preceded by a fluid stream and followed by another fluid stream in accordance with one embodiment of the present invention.

During cementing operations, the apparatus and methods of the present invention may allow for the use of multiple bottom plugs to serve as fluid separators. FIG. 2 illustrates a cross sectional view of the catcher tube assembly 200 with deformable device 205 preceded by fluid stream 210 and followed by fluid stream 215.

A deformable device 205 may be any device capable of deforming to fit into catcher tube 220 and capable of separating fluids and wiping a casing string, which may contain a multiplicity of internal diameters. The multiplicity of internal diameters within the casing string may be a result of, for example, a tapered casing string, internal restrictions imposed by the interjection of a plug operated stage cementing device, or a combination of both. Deformable devices may include, but are not limited to, compressible devices, floppy wiper plugs, and floppy wiper darts. A compressible device, as used herein, may be any device capable of compressing to fit into catcher tube 220 and capable of separating fluids and wiping a casing string, which may contain a multiplicity of internal diameters. Examples of compressible devices suitable for use in conjunction with the apparatus and methods of the present disclosure include elastomeric balls and foam darts. U.S. Pat. No. 6,973,966 issued on Dec. 13, 2005 to Szarka, which is herein incorporated by reference, discloses compressible darts suitable for use in conjunction with the methods and apparatus of the present disclosure. An elastomeric ball may be a solid rubber ball or a foam ball made from an elastomer. In certain embodiments, a multiplicity of floppy wiper plugs or darts may be used in conjunction with the apparatus and methods of the present disclosure. The apparatus and methods of the present disclosure may prevent such plugs or darts from wedging beside each other inside the unrestricted casing bore, which may increase circulation pressures significantly or could potentially bridge the casing against further fluid displacement.

In certain embodiments, deformable device 205 may be loaded and released into casing string 240 from any suitable plug container. In certain other embodiments, deformable device 205 may be inserted directly into the casing string 240. As illustrated in FIG. 2, deformable device 205 may wipe the inner surface of casing string 240 to reduce contamination of fluid streams by residual fluids present on the inner surface of casing string 240.

Figure 3:
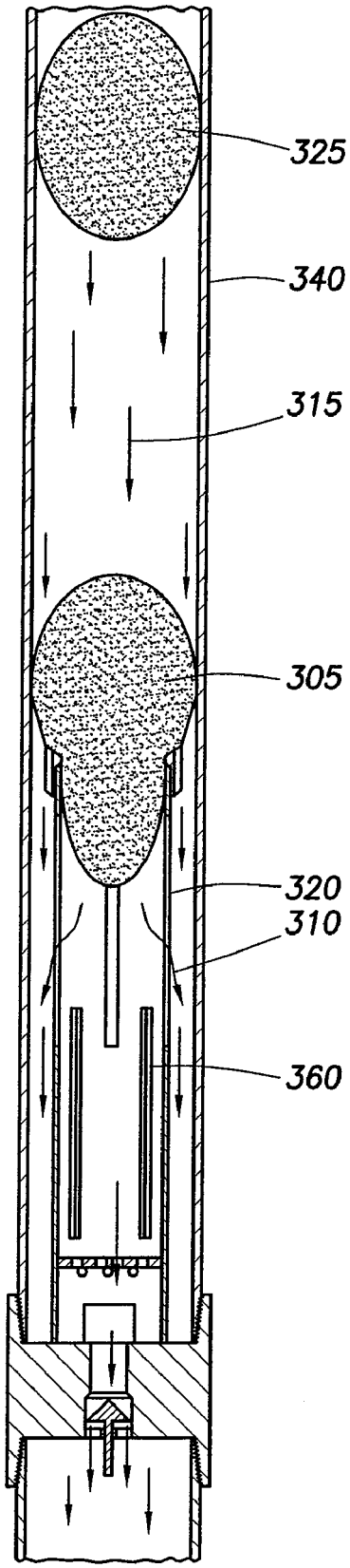
FIG. 3 illustrates the deformable device of FIG. 2 as it deforms to fit into the catcher tube assembly, followed by an additional deformable device.

FIG. 3 shows deformable device 305 in the process of deformation to fit into catcher tube 320 in response to pressure exerted on deformable device 305 by fluid stream 315. This forces fluid stream 310 to flow through the slots 360 of catcher tube 320. Fluid streams 315 and 310 may comprise any fluid suitable for use in cementing operations including, but not limited to, drilling fluids, displacement fluids, cement slurries, and spacer fluids. Following fluid stream 315 is a second deformable device 325 which may wipe any residual fluid present on the inner surface of casing string 340 prior to introduction of a third fluid stream.

Figure 4:
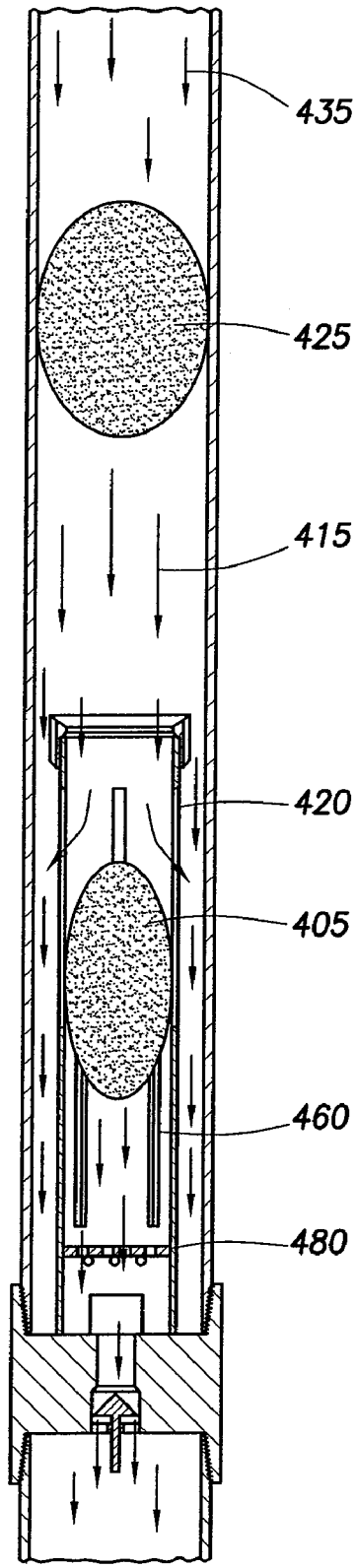
FIG. 4 illustrates the deformable device of FIG. 3 as it translates downward into the catcher tube assembly, followed by the additional deformable device separating a fluid stream.

Turning now to FIG. 4, deformable device 405 is positioned within catcher tube 420. Fluid stream 415, in addition to flowing around catcher tube 420, may flow through the slots 460 of catcher tube 420 as well as through the perforations of plate 480. A second deformable device 425 separates fluid stream 415 from a third fluid stream 435. Fluid stream 435 may comprise any fluid suitable for use in cementing operations including, but not limited to, drilling fluids, displacement fluids, cement slurries, and spacer fluids.

Figure 5:
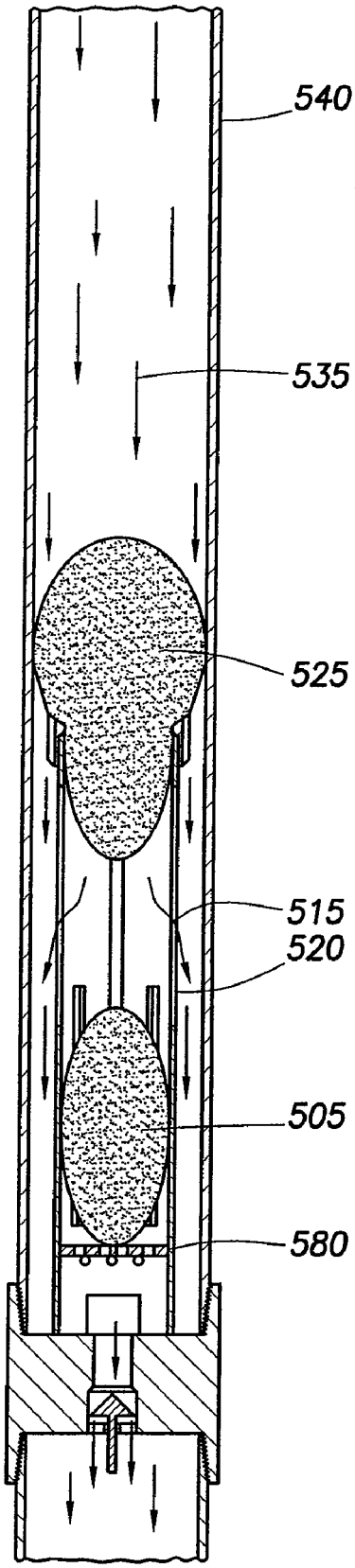
FIG. 5 illustrates the additional deformable device of FIG. 4 as it deforms to fit into the catcher tube assembly.

Looking now to FIG. 5, deformable device 505 rests atop deformable device seat 580. Fluid stream 515 is forced through and around catcher tube 520 with the pressure exerted from second fluid stream 535 and deformable device 525. Second deformable device 525, which may have wiped the inner surface of the uppermost portions of casing string 540 may deform to fit within catcher tube 520.

Figure 6:
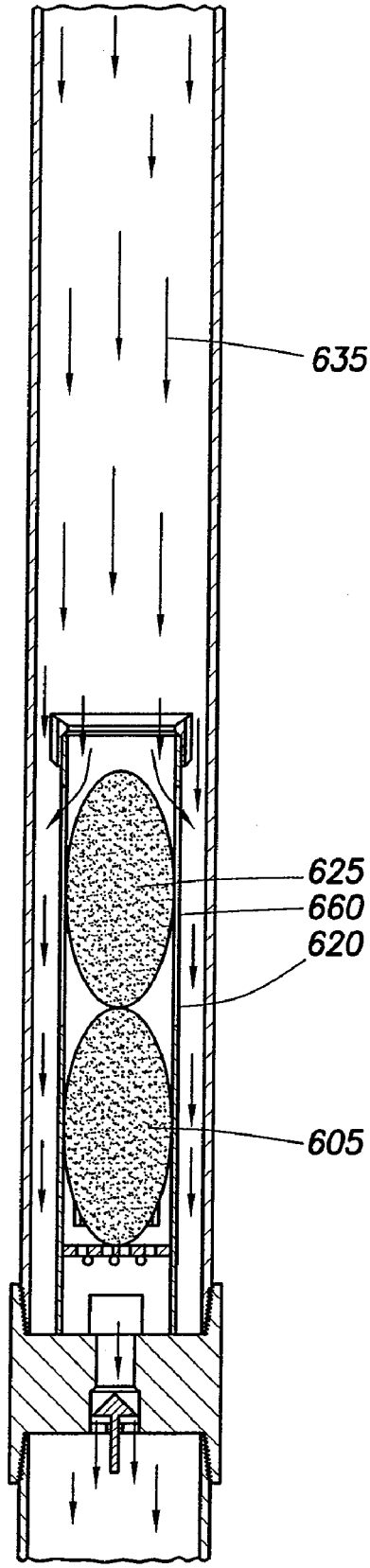
FIG. 6 illustrates the deformable devices of FIGS. 1-5 in a resting position in the catcher tube assembly.

Turning now to FIG. 6, deformable device 625 may come to rest on top of deformable device 605. Fluid stream 635 is allowed to flow around catcher tube 620 and through slots 660 of catcher tube 620. In this way, multiple deformable devices, which serve as bottom plugs, may be run with any plug operated cementing device.

In certain embodiments, fluid stream 635 may be a cement slurry. A top plug (not shown) may follow fluid stream 635. The top plug may be, for example, a conventional top plug or a first stage shut off plug. In these embodiments, a shut off baffle collar (not shown) may be positioned above the catcher tube. The shut off baffle collar may provide a landing site for a top plug. By using the apparatus of the present disclosure, contamination of the cement slurry may be reduced and separation of different types of fluid streams may be achieved.

In certain other embodiments, when cementing tapered casing strings, the deformable device and catcher tube assembly of the present disclosure may eliminate the need for expensive combination plugs. As the deformable device followed by a fluid stream is pumped within a tapered casing string, the deformable device of the present disclosure has the ability to deform to wipe all diameters of casing of a tapered casing string, thereby eliminating the need for fabrication of an expensive combination bottom plugs to perform such task.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values, and set forth every range encompassed within the broader range of values. Also, the terms in the claims have their plain, ordinary meaning unless otherwise explicitly and clearly defined by the patentee.

What is claimed is:

1. A method of cementing a casing string comprising:

flowing a first fluid stage through the casing string, wherein the first fluid stage comprises at least one fluid selected from the group consisting of: a drilling fluid, a displacement fluid, a spacer fluid, and any derivative thereof;

flowing a second fluid stage through the casing string, wherein:

a deformable device separates the first fluid stage and the second fluid stage; and the second fluid stage comprises a cement slurry; and catching the deformable device in a catcher tube assembly disposed within an inner diameter of the casing string, wherein the catcher tube assembly comprises a catcher tube adapted for catching the deformable device and adapted to permit fluid flow between the catcher tube and the casing string after the deformable device has deformed to at least partially enter the catcher tube.

2. The method of claim 1, wherein the deformable device comprises a device selected from the group consisting of: a compressible device, a floppy wiper plug, a floppy wiper dart, a plug, an elastomeric ball, a foam dart, and any combinations thereof.

3. The method of claim 1, wherein the catcher tube assembly further comprises a centralizer.

4. The method of claim 1, wherein the casing string is a tapered casing string.

5. The method of claim 1, wherein the catcher tube assembly is further adapted to permit fluids to flow through one or more slots disposed on the catcher tube.

6. The method of claim 1, further comprising:

releasing the deformable device into the casing string from a plug container.

7. The method of claim 1, further comprising:

flowing a third fluid stage through the casing string, wherein a second deformable device separates the second fluid stage and the third fluid stage; and catching the second deformable device in the catcher tube assembly.

* * * * *